United States Patent [19]

Ervin et al.

[11] Patent Number: 4,894,592

[45] Date of Patent: Jan. 16, 1990

[54] ELECTRODELESS LAMP ENERGIZED BY MICROWAVE ENERGY

[75] Inventors: Robert M. Ervin, Silver Spring; Joseph Perret, Germantown, both of Md.

[73] Assignee: Fusion Systems Corporation, Rockville, Md.

[21] Appl. No.: 197,351

[22] Filed: May 23, 1988

[51] Int. Cl.[4] ..... H05B 37/00

[52] U.S. Cl. ..... 315/248; 315/85; 315/119

[58] Field of Search ..... 315/85, 112, 117, 119, 315/248; 313/44, 146, 231.61

[56] References Cited

U.S. PATENT DOCUMENTS 4,485,332 11/1984 Ury et al. ..... 315/248 X

*Primary Examiner*—Eugene R. LaRoche
*Assistant Examiner*—Robert J. Pascal
*Attorney, Agent, or Firm*—Pollock, Vande Sande & Priddy

[57] ABSTRACT

Apparatus for inactivating the source of microwaves for an electrodeless lamp to prevent accidental release of microwaves into the environment as a result of failure to assemble the lamp with a conductive mesh. An electrodeless lamp which is provided with a gas manifold for directing a stream of cooling gas against a lamp envelope is provided with a gas leak passageway which is blocked when the conductive mesh assembly is in place. A pressure switch in fluid communication with the gas manifold is activated and prevents operation of the microwave source when pressure is reduced as a result of gas leaking through the gas leak passageway.

4 Claims, 3 Drawing Sheets

ELECTRODELESS LAMP ENERGIZED BY MICROWAVE ENERGY

This invention relates to electrodeless lamps which are energized by microwave energy.

BACKGROUND OF THE INVENTION

The electrodeless lamps with which this invention is concerned in general comprise a lamp envelope containing a plasma-forming medium. To operate the lamps, the medium in the envelope is excited with microwave, R.F. or other electronic energy, thereby generating a plasma, which emits radiation in the ultraviolet, visible or infrared part of the spectrum. The lamp is typically mounted in a microwave chamber having an opening which is covered by a conductive mesh which is effective to retain microwave energy in the chamber while allowing light emitted by the lamp to escape.

If the opening is not covered with the conductive mesh, large quantities of microwave energy escape into the environment and endanger nearby personnel. The possibility exists that the mesh could be omitted during reassembly following repair or replacement of lamp components, and the need exists to prevent accidents arising from a failure to assemble or use a lamp properly.

SUMMARY OF THE INVENTION

It is accordingly one object of this invention to provide means for preventing accidental release of microwaves into the environment from an electrodeless lamp.

It is another object of this invention to provide means for inactivating the source of microwaves for an electrodeless lamp when conductive mesh is not properly in place.

In accordance with this invention, there is provided an electrodeless lamp comprising a lamp envelope containing a plasma-forming medium mounted within a microwave chamber which is bounded, at least in part, by a conductive mesh in a mesh assembly for retaining microwaves and permitting escape of light from the chamber. Means including a gas manifold is provided for directing a stream of cooling gas to the outer surface of the envelope. The manifold is provided with a gas leak passageway which is blocked by gas blockage means which are a part of the conductive mesh assembly. Means are provided to sense gas pressure within the gas manifold and to activate means to prevent microwaves from entering the microwave chamber when the gas pressure indicates that the gas is leaking through the gas leak passageway.

DETAILED DESCRIPTION OF THE INVENTION

Figure 1:
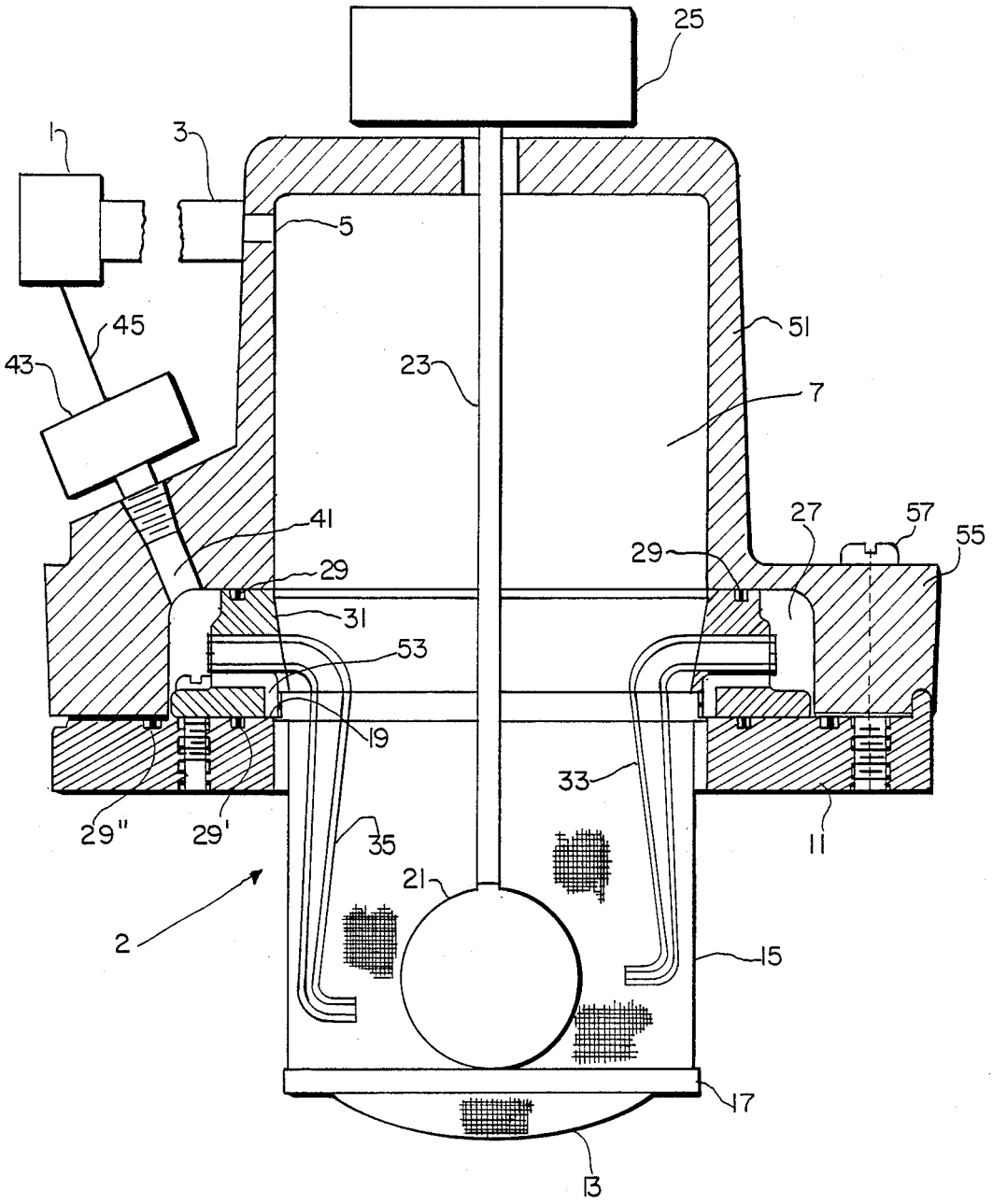
FIG. 1 is a sectional view of an electrodeless lamp showing an embodiment of this invention in which the gas leak passageway comprises passageways formed in a housing.

The light source shown in FIG. 1 is comprised of spherical lamp envelope 21 and microwave chamber 7 in which the lamp is disposed. Microwave chamber 7 is defined by microwave reflecting wall 51 and mesh assembly 2, which is effective to retain microwave energy in the chamber and yet allow light emitted by lamp envelope 21 to escape.

Lamp envelope 21 is filled with a plasma-forming medium as, for example, mercury in a noble gas. When excited with microwave energy this medium becomes a hot plasma which emits ultraviolet radiation. The microwave energy is supplied by microwave source 1 (not to scale) which comprises a power source and a magnetron. The microwave energy emitted by the magnetron is coupled to chamber 7 by rectangular waveguide 3. Chamber 7 has an opening 5 therein for admitting the microwave energy to the chamber and exciting the plasma in envelope 21.

The envelope 21 becomes extremely hot during operation of the lamp and means for cooling the envelope are essential for high power operation. As shown in FIG. 1, means are provided for introducing cooling gas into chamber 7 from a source of pressurized gas (not shown). These means include manifold 27 and air jets 33, 35 which are mounted in jet block 31.

Lamp envelope 21 is supported within chamber 7 by stem 23, and motor 25 is provided for rotating stem 23 of the lamp envelope. Details of the gas cooling and lamp rotating structures are shown in U.S. Pat. No. 4,485,332 issued Nov. 27, 1984, to Ury et al, and the disclosure of that patent is hereby incorporated by reference.

Conductive mesh assembly 2 is cup-shaped and comprises end mesh 13, cylindrical side wall mesh 15, ring 17 interconnecting end mesh 13 with side wall mesh 15, and ring-like flange 19 at the open end of mesh structure 2. Flange 19 is held in place between jet block 31 and screen retaining ring 11. Jet block 31 is secured between screen retaining ring 11 and flange 55 which are held together with bolts 57 (only one shown).

Manifold 27 is provided with leak passageway 53 which is blocked by flange 19 when mesh assembly 2 is in place between screen retaining ring 11 and jet block 31. O-rings 29, 29′ and 29″ are provided in jet block 31 and retaining ring 11.

Gas conduit 41 extends from manifold 27 to pressure switch 43. Gas leaking through passageway 53 results in a reduction of the gas pressure in the manifold 27. The reduced pressure activates switch 43 which sends a signal via line 45 to prevent the operation of microwave source 1.

Figure 2:
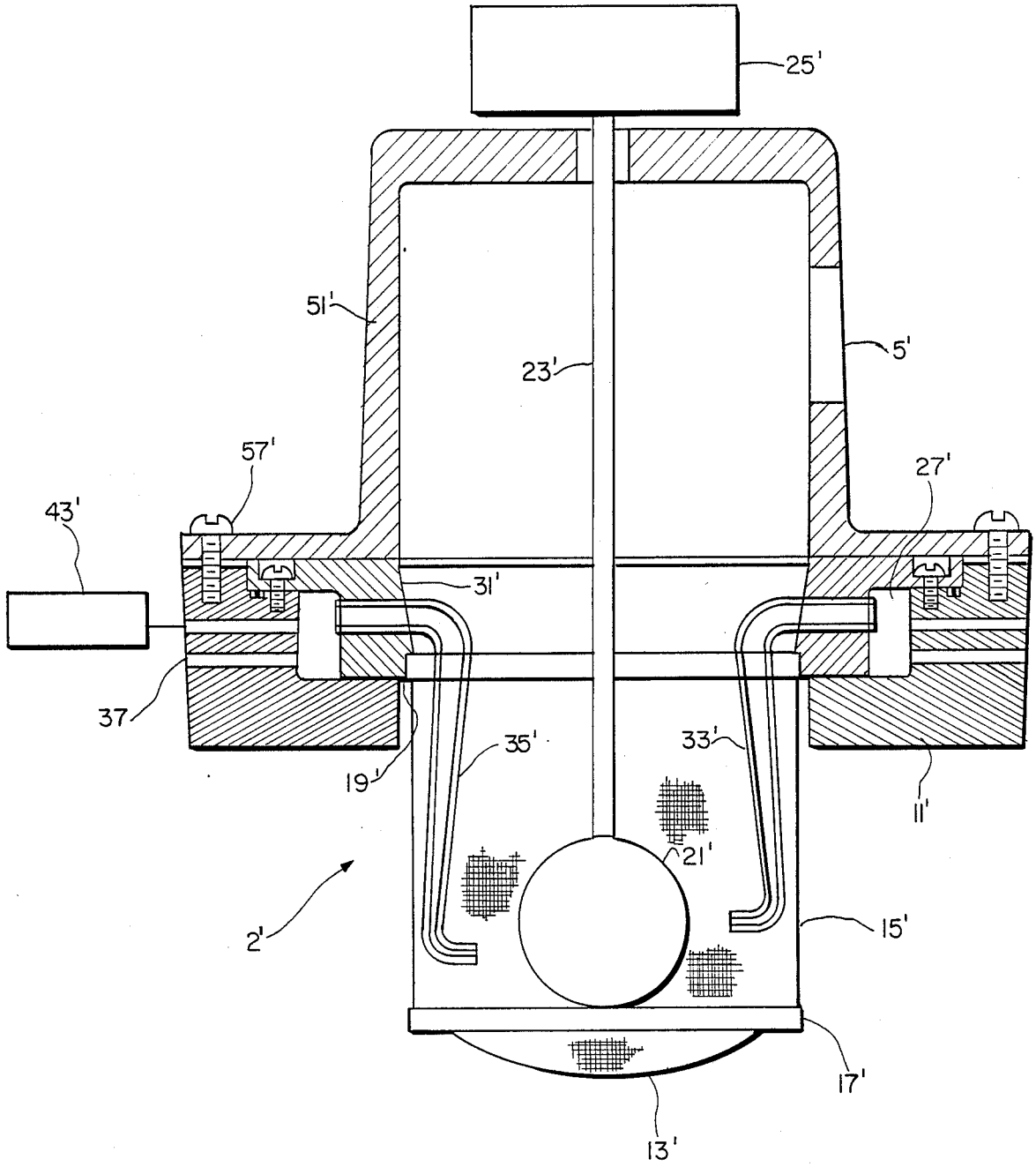
FIG. 2 is a sectional view of another embodiment of the present invention.
Figure 3:
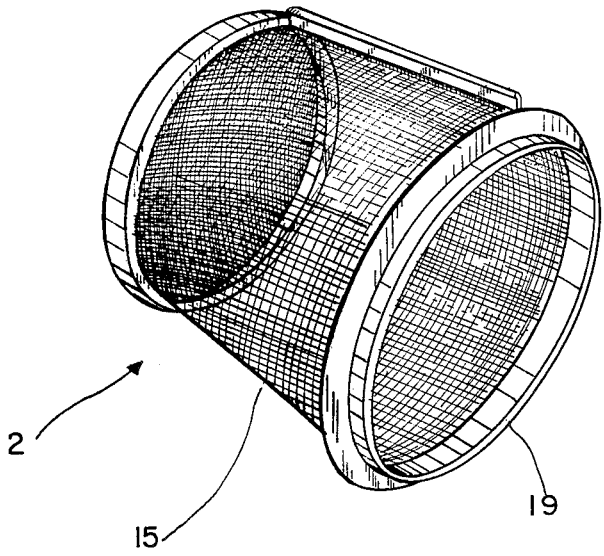
FIG. 3 is a view in perspective of the conductive mesh assembly shown in FIGS. 1 and 2.

FIG. 2 shows a modification of the lamp of FIG. 1 in which the assembly is provided with a circumferential gap between screen retaining ring 11′ and jet block 31′. The gap provides a leak passageway which is blocked by flange 19′ when the conductive mesh assembly 2 is in place. Pressurized air inlet 37 is shown in FIG. 2.

Having thus described the invention the following Examples are offered to illustrate it in detail.

EXAMPLE 1

An electrodeless lamp is provided in accordance with FIG. 1 in which air is introduced into the manifold at a rate of 3.5 standard cubic feet per minute. Four air jets, each having a 0.070 inch diameter orifice, are used to cool the lamp envelope. The pressure in the manifold is 4.5 psi under operating conditions. Two leak paths 0.125 inch in diameter are provided in the jet block, and the pressure switch is set to prevent operation of the microwave source when the pressure in the manifold is less than 3 psi.

Example 2

An electrodeless lamp constructed in accordance with FIG. 2 is provided with a 0.022 inch gap between the jet block and the screen retaining ring. The flange for the screen assembly fills this gap and prevents air leakage when the screen assembly is in place.

The foregoing Examples are intended to illustrate and not limit the present invention. Modifications and variations may occur to those skilled in the art, and the scope of the invention is limited solely by the claims appended hereto and equivalents thereof.

What is claimed is:

1. An electrodeless lamp comprising:

(a) a microwave cavity;

(b) a source of microwaves in communication with said cavity;

(c) a lamp envelope containing a plasma-forming medium mounted within said microwave cavity;

(d) a gas manifold for feeding gas to at least one gas passageway for directing a stream of gas to the outer surface of said envelope;

(e) a gas leak passageway leading from said gas manifold;

(f) a conductive mesh assembly for retaining microwaves within said cavity and permitting light to be emitted from said cavity, said assembly including gas flow blocking means for preventing the flow of gas through said gas leak passageway when said screen is in place in the lamp; and, (g) means for shutting off said source of microwaves when the gas pressure in said manifold drops below a predetermined value.

2. An electroless lamp in accordance with claim 1 wherein said gas flow blocking means comprises a flange for supporting said mesh assembly in position in said lamp.

3. An electrodeless lamp in accordance with claim 1 wherein said conductive mesh is cup-shaped, and said means for preventing the flow of gas through said gas leak passageway comprises a circular flange mounted at the open end of said cup-shaped mesh assembly for supporting said mesh assembly in said lamp.

4. An electrodeless lamp in accordance with claim 1 wherein said means for detecting the pressure of gas within said manifold comprises a pressure-activated switch for turning off the source of microwaves.

* * * * *